US006520970B1

(12) United States Patent
Sanchez-Martinez

(10) Patent No.: US 6,520,970 B1
(45) Date of Patent: Feb. 18, 2003

(54) ATTACHMENT FOR AN APPARATUS FOR PLUCKING HAIRS FROM HUMAN SKIN

(75) Inventor: Pedro Sanchez-Martinez, Kronberg (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/622,264

(22) PCT Filed: Feb. 3, 1999

(86) PCT No.: PCT/EP99/00704

§ 371 (c)(1),
(2), (4) Date: Aug. 14, 2000

(87) PCT Pub. No.: WO99/44462

PCT Pub. Date: Sep. 10, 1999

(30) Foreign Application Priority Data

Mar. 5, 1998 (DE) ..... 198 09 436

(51) Int. Cl.[7] ..... A61B 17/50
(52) U.S. Cl. ..... 606/133; 606/131; 606/132
(58) Field of Search ..... 606/131–133

(56) References Cited

U.S. PATENT DOCUMENTS

| | | | | |
|---|---|---|---|---|
| 5,507,753 A | * | 4/1996 | Iwasaki et al. | 606/133 |
| 5,810,843 A | * | 9/1998 | Iwasaki et al. | 606/133 |
| 6,156,182 A | * | 12/2000 | Caric et al. | 606/133 |

FOREIGN PATENT DOCUMENTS

| | | |
|---|---|---|
| DE | 44 08 809 C1 | 6/1995 |
| DE | 195 21 585 A1 | 12/1996 |
| EP | 0 760 219 A1 | 3/1997 |
| EP | 0 795 283 A1 | 9/1997 |
| EP | 0 807 388 A1 | 11/1997 |
| WO | WO 97/00032 | 1/1997 |

* cited by examiner

*Primary Examiner*—John J. Calvert
*Assistant Examiner*—Robert H Muromoto, Jr.
(74) *Attorney, Agent, or Firm*—Fish & Richardson PC

(57) ABSTRACT

An attachment for an appliance for the epilation of the human skin, the appliance being provided with a housing to accommodate a motor for driving at least one clamping device rotary about a first axle for purposes of epilation, the attachment being provided with at least one element for reducing the perception of pain during epilation, which element makes contact with the skin prior to the epilation.

18 Claims, 4 Drawing Sheets

ATTACHMENT FOR AN APPARATUS FOR PLUCKING HAIRS FROM HUMAN SKIN

BACKGROUND

This invention relates to an attachment for an appliance for the epilation of the human skin, said appliance being provided with a housing to accommodate a motor for driving at least one clamping device rotary about a first axle for purposes of epilation.

An appliance of this type is known from German Offenlegungsschrift DE 195 21 585 A1. This specification describes an epilation appliance for extracting hairs from the human skin, comprising a rotary cylinder provided with a plurality of clamping devices and received in a housing and driven by a motor. With the epilation appliance in operation, the rotary cylinder executes a rotating movement during which the clamping devices perform a cyclic clamping movement. When the user places the epilation appliance against the skin, the clamping movements cause the hairs to be captured by the clamping devices and extracted.

The known epilation appliance is further provided with devices delivering to the skin a one-time pulse before each epilating action. This pulse produces a pain which the user perceives as less discomforting than the actual pain caused by the epilation.

The design effort involved in providing such devices is considerable. It is therefore an object of the present invention to provide an appliance which, while involving little effort, enables the user's perception of pain to be reduced during epilation.

SUMMARY

According to the present invention, this object is accomplished in an appliance of the type initially referred to in that the attachment is provided with at least one element for reducing the perception of pain during epilation, which element makes contact with the skin prior to the epilation.

Hence provision is made for an additional attachment to the epilation appliance in which the pain reducing devices are contained. With this arrangement it is not necessary to make the high design effort to integrate these devices into the appliance itself, but it will be sufficient to use the attachment on the unchanged epilation appliance. Obviously, with regard to design implementation and costs thereby incurred, this presents a substantially simpler possibility of reducing the pain of epilation by having suitable pulses precede the epilation.

Another advantage of the present invention resides in that also existing epilation appliances may be provided with the attachment, hence making retrofitting and thus an attendant improvement of existing epilation appliances possible.

Moreover it is possible for the attachment, after use, to be removed from the epilation appliance and cleaned separately. This provides another simplification and improvement with regard to manipulation of the epilation appliance.

In an advantageous aspect of the present invention provision is made for a second axle which is aligned approximately parallel to the first axle and receives the element in a rotary manner. Particularly conveniently, the element is a wheel or a gear or the like which rolls off along the skin ahead of the epilation. The term "gears" as used herein is to be interpreted as including stimulating wheels, toothed disk, profiled disk and any other element suited to stimulate the human skin.

As the user moves the epilation appliance across the skin, the gears will invariably contact the skin ahead of the clamping devices. Stimulation of the skin is effected by the teeth of the gear rolling off along the skin. This stimulating effect occurs prior to the actual epilation performed by the clamping devices. Owing to the stimulation the user's perception of pain is reduced at the place undergoing stimulation. As a result, the user perceives the subsequent epilation as less painful.

In an advantageous further aspect of the present invention, a plurality of elements are rotatably arranged on the second axle in a spaced, juxtaposed relationship to each other. In this arrangement it is of particular convenience if the plurality of elements are adapted to rotate independently of each other.

Owing to the plurality of independent gears the stimulating effect is further enhanced on those portions of the skin subjected to stimulation, so that overall the pain caused by the subsequent epilation is further reduced.

In another advantageous aspect of the present invention, provision is made for a third axle which is aligned approximately parallel to the first axle and has mounted on it a roller or a shaft or the like for rotation thereon.

The roller operates to stretch the skin tight during the epilation. This makes it easier for the clamping devices to capture the hairs.

In a still further advantageous aspect of the present invention, the mounts of the second and/or third axle are pivotally constructed so as to be able to recede in the direction of the housing. For this arrangement it is particularly convenient if the second and/or third axle is spring loaded such as to project from the housing.

This enables in particular the gears to conform themselves to and follow any curved contour of the skin automatically.

Particularly advantageously, the attachment is a push-fit on the housing and, where provided, is releasably lockable thereon.

It is noted expressly that the present invention may not only be implemented as an attachment but may also be formed as an integral part of the epilation appliance per se. It will be appreciated that by virtue of the simple configuration of the present invention also this embodiment of the invention affords material advantages over known epilation appliances.

Further features, application possibilities and advantages of the present invention will become apparent from the subsequent description of embodiments of the invention illustrated in the Figures of the accompanying drawings. It will be understood that any single feature and any combination of single features described or represented by illustration form the subject-matter of the present invention, irrespective of their summary in the patent claims or their back reference, as well as irrespective of their wording and representation in the description and the drawings, respectively.

DETAILED DESCRIPTION

Figure 1:
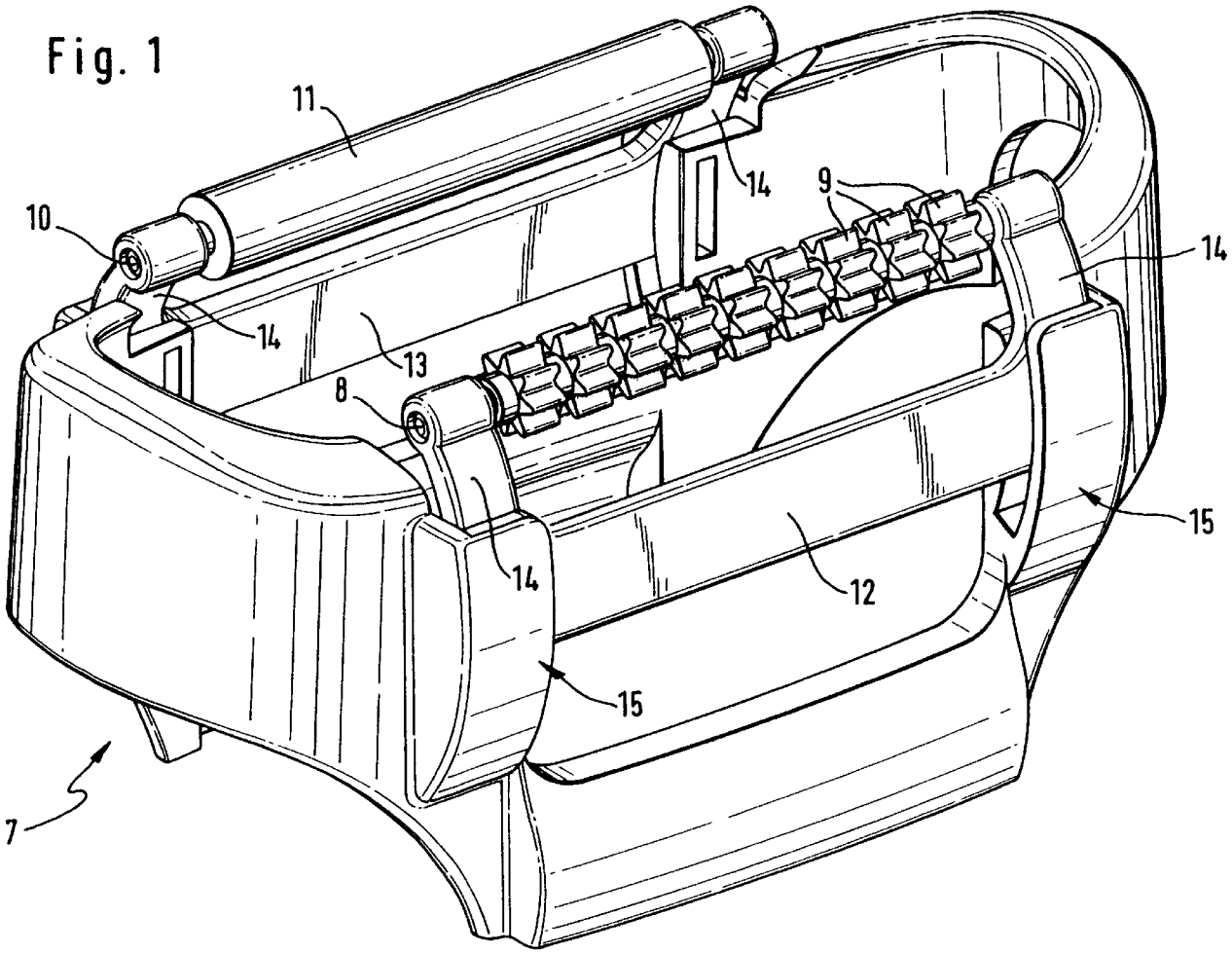
FIG. 1 is a schematic perspective view of an embodiment of an attachment of the invention for use on an appliance for epilating the human skin.
Figure 2:
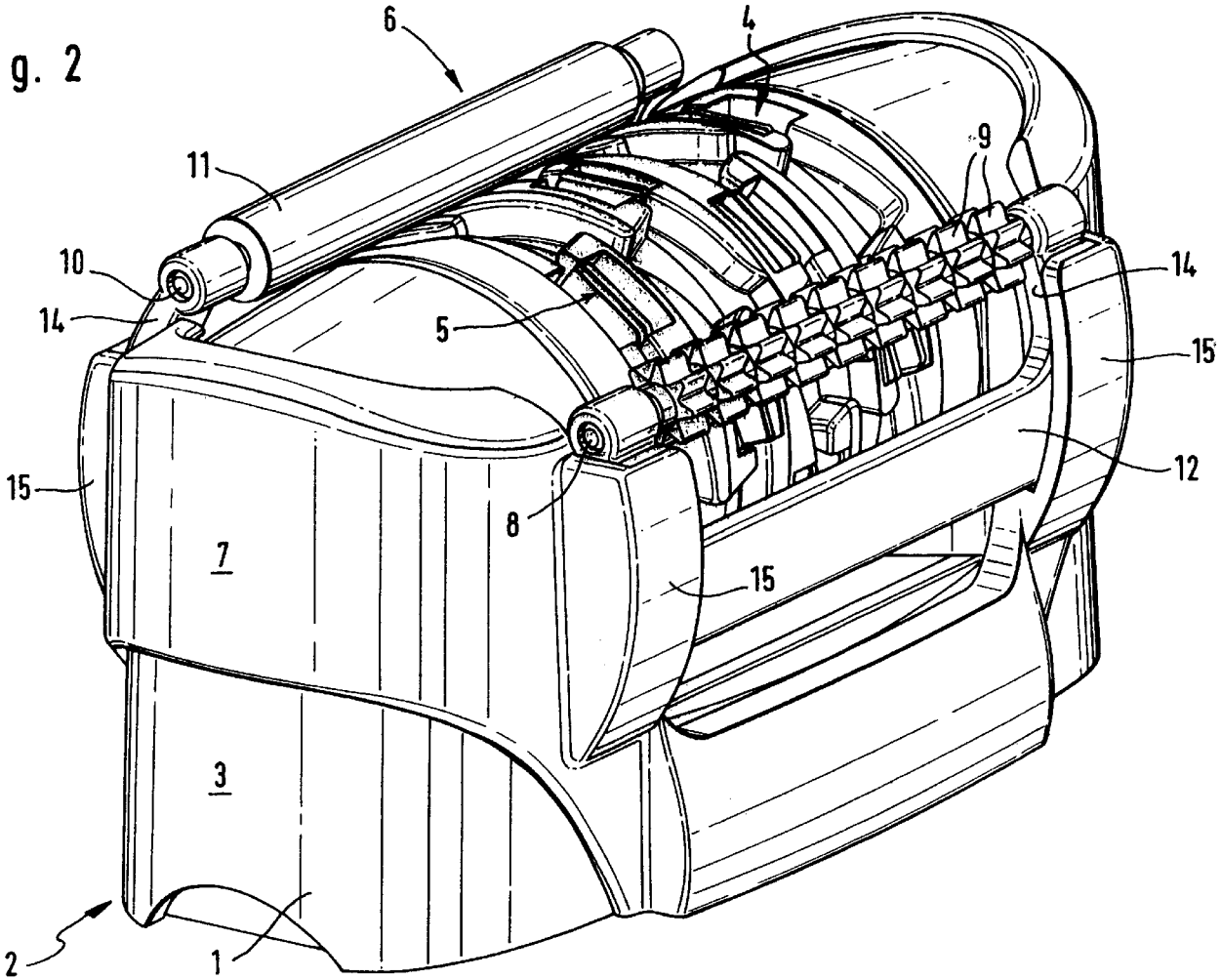
FIG. 2 is a schematic perspective view of the attachment of FIG. 1 as attached to the epilation appliance.

The features described in the following with reference to FIGS. 1 to 3 are suited to operate in conjunction with an epilation appliance of the type described in German Offenlegungsschrift DE 195 21 585 A1 and/or in European Offenlegungsschrift EP 596 283 A1. The disclosure content of these two laid open patent applications shall be deemed to be incorporated herein by express reference.

In particular FIG. 2 shows an epilation head 1 of an appliance 2 for epilating the human skin as described in the two laid open patent applications referred to above. The epilation head 1 comprises a housing 3 receiving therein a rotary cylinder 4 mounted for rotation about a first axle. Accommodated in the appliance 2 is a motor adapted to drive the rotary cylinder 4. The rotary cylinder 4 is provided with a plurality of clamping devices 5 extending through an opening 6 in the housing 3 to be placed in contact with the skin. With the appliance 2 in operation, the clamping devices 5 cooperate with the rotary cylinder 4 to execute a rotary movement during which the clamping devices 5 perform an additional cyclic clamping movement in the area of the opening 6. When the clamping devices 5 are in engagement with the skin, the hairs close to the clamping devices 5 while the clamping movement takes place are captured by the clamping devices 5 and extracted.

As shown in particular in FIG. 1, an attachment 7 is provided which may be push-fitted onto the epilation appliance 2. To accomplish this, the attachment 7 and the housing 3 of the epilation head 1 have cooperating molded parts or the like suitably shaped to enable the attachment 7 to be seated onto the housing 3 in particular by positive engagement therewith. If desired, devices may be provided to enable the attachment 7 to be releasably locked on the housing 3.

The attachment 7 has a second axle 8 arranged approximately parallel to the first axle of the rotary cylinder 4. Arranged on the second axle 8 side-by-side in spaced relation to each other are a plurality of gears 9 mounted for rotation on the second axle 8. The second axle 8 with its gears 9 is of a longitudinal dimension corresponding approximately to the longitudinal dimension of the rotary cylinder 4. Looking transverse to the longitudinal dimension of the second axle 8, the gears 9 are arranged in close proximity to the rotary cylinder 4.

The individual gears 9 on the second axle 8 are adapted to rotate independently of each other. They are also adapted to rotate independently of the direction of rotation of the motor and/or the rotary cylinder 4. It will be appreciated however that it is also possible for the gears 9 to be coupled to each other and driven individually or jointly in particular by the rotary cylinder 4 or the motor.

The attachment 7 has a third axle 10 arranged approximately parallel to the first axle of the rotary cylinder 4. Provided on the third axle 10 is a roller 11 mounted for rotation on the third axle 10. The third axle 10 and the roller 11 are of a longitudinal dimension corresponding approximately to the longitudinal dimension of the rotary cylinder 4. Furthermore, the longitudinal dimensions of the second axle 8 and the third axle 10 are approximately equal. Looking transverse to the longitudinal dimension of the third axle 10, the roller 11 is arranged in close proximity to the rotary cylinder 4.

The roller 11 is adapted to rotate independently of the rotation of the motor and/or the rotary cylinder 4 and/or the gears 9. It will be appreciated however that it is also possible for the roller 11 to be driven by the rotary cylinder 4 or the motor. Similarly, it is possible for the roller 11 and the gears 9 to be coupled to each other so as to rotate in unison.

The second axle 8 is held on a frame 12, and the third axle 10 is held on a frame 13. Each of the frames 12, 13 is of an approximately U-shaped configuration having legs 14 on whose free ends the respective axle 8, 10 is supported. Furthermore, the legs 14 of the frames 12, 13 are of an arcuate or curved configuration to conform approximately to the shapes of the attachment 7 and the housing 3.

The two frames 12, 13 retract into the attachment 7 and are retained therein by suitable devices. Guides 15 provided in the attachment 7 enable the frames 12, 13 to be displaced in the direction of the legs 14. The length of displacement is limited by corresponding stops. The guides 15 accommodate springs or the like by means of which the frames 12, 13 are urged out of the attachment.

The two frames 12, 13 are displaceable within the guides 15 independently of each other. In this way the gears 9 and the roller 11 are extensible from, and retractable into, the attachment 7 independently of each other. However, the possibility also exists for the frames 12, 13 to be coupled to each other, hence performing a joint pivotal motion.

In this latter case this joint pivotal motion may serve an additional purpose, using it, for example, for adjusting the closing instant of the clamping devices 5.

Figure 3B:
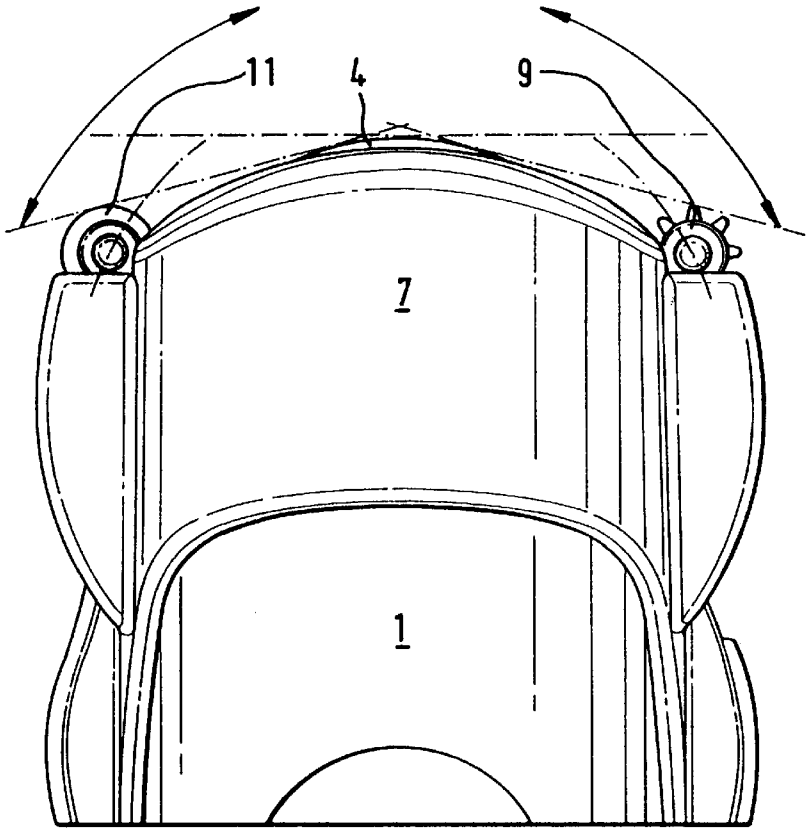
FIGS. 3*a* to 3*d* are schematic side views of the attachment of FIG. 1 as push-fitted to the appliance, illustrating various positions.
Figure 3A:
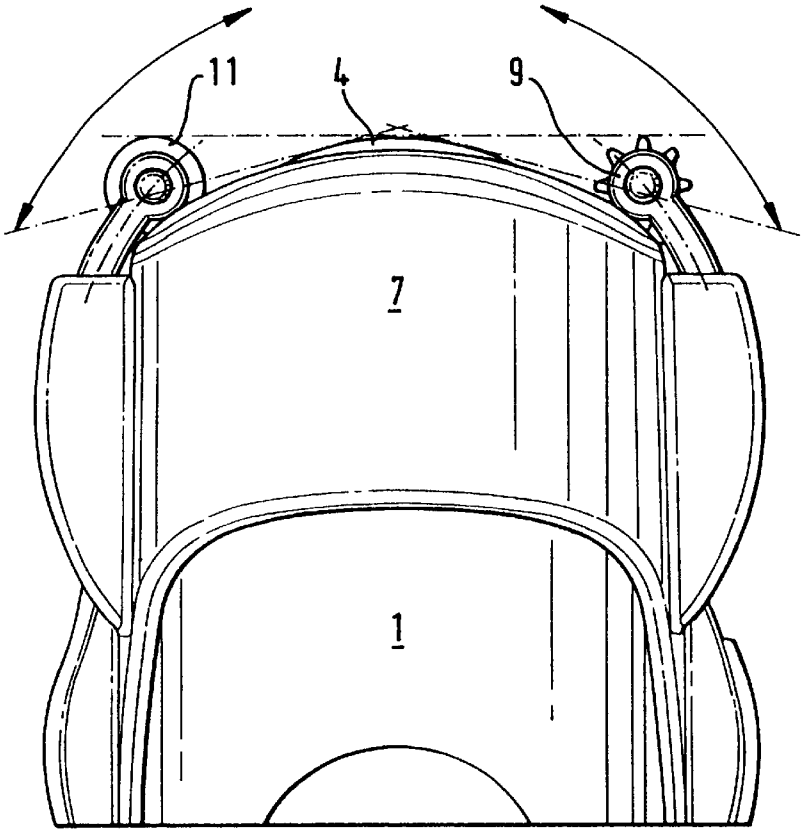
Figure 3D:
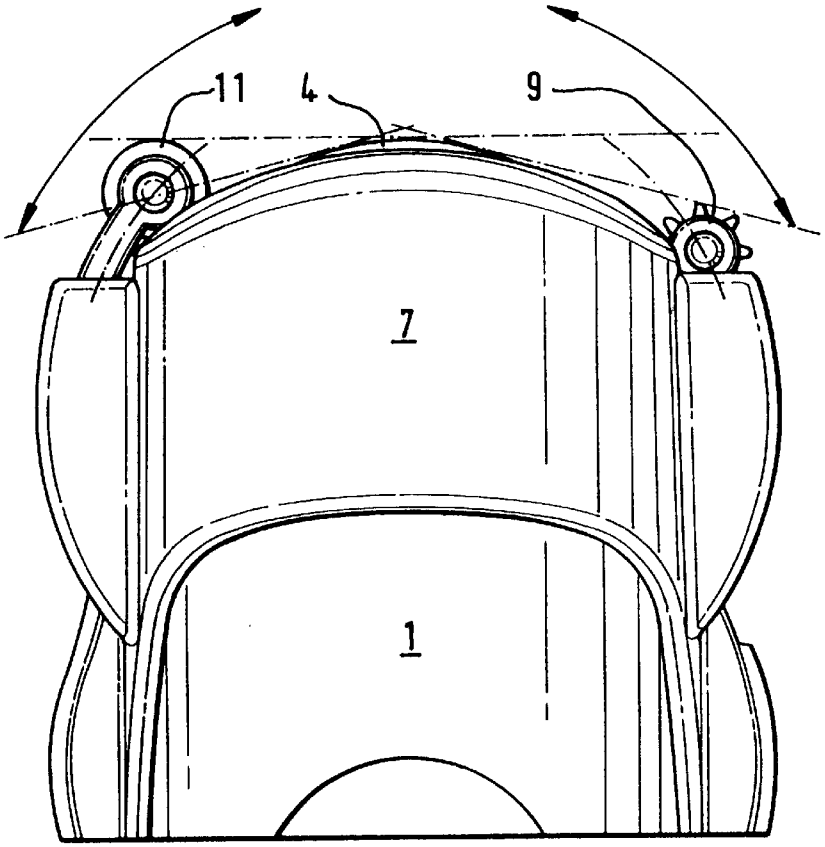
Figure 3C:
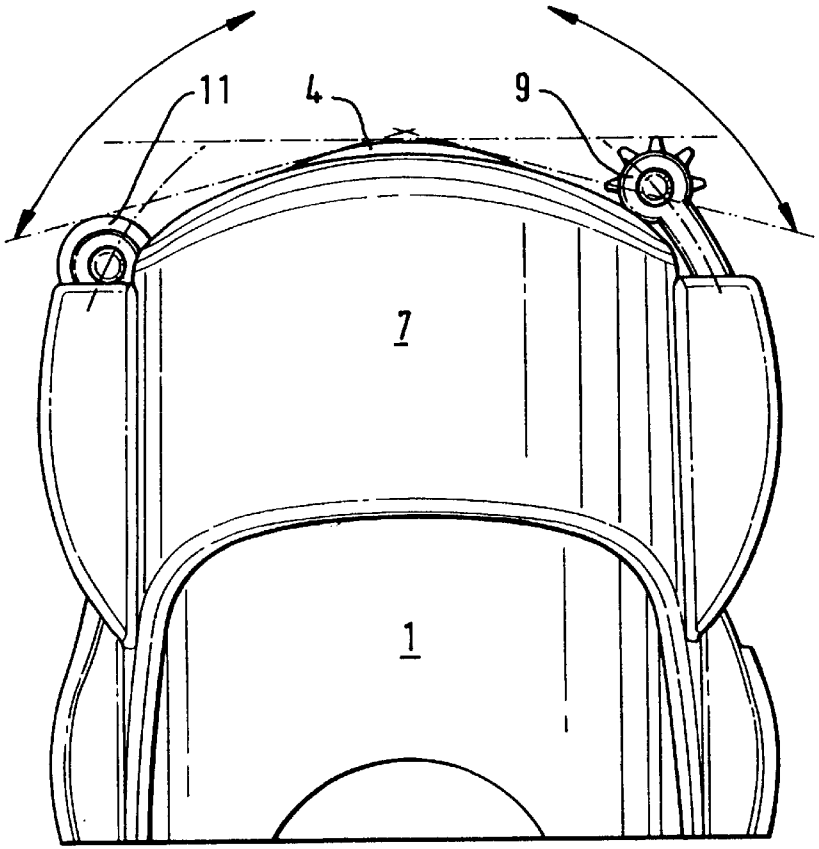

In particular FIGS. 3*a* to 3*d* show various positions of the frames 12, 13 and hence of the second axle 8 with its gears 9 and the third axle 10 with its roller 11. As shown in FIG. 3*a,* the gears 9 and the roller 11 are in an extended normal position as obtained by the spring load and maintained in the absence of external impact. In FIG. 3*b* the frames 12, 13 are fully retracted within the attachment 7 so that the gears 9 and the roller 11 are also in a retracted position. FIGS. 3*c* and 3*d* show, by way of example, two of a plurality of intermediate positions in which the gears 9 and the roller 11 may occupy independently of each other any position between the respective normal position and the retracted position.

In operation of the appliance 2, the user will place the rotating rotary cylinder 4 with the clamping devices 5 against the skin. As a result, the gears 9 and the roller 11 will likewise make contact with the skin, particularly by engaging it. The user will then move the appliance 2 across the skin in such a way that the gears 9 are ahead of the clamping devices 5 as seen looking in the direction of movement. In consequence, the gears 9 will roll off along the skin ahead of the clamping devices 5.

The rolling action of the teeth of the gears 9 stimulates the skin. This stimulation has the effect of reducing the user's perception of pain at this particular location. As set forth in the foregoing, the skin is stimulated before the hairs are extracted by the clamping devices 5. Since the perception of pain is reduced, the pain produced by the actual epilation is felt as less severe.

The roller 11 operates to stretch the skin tight during epilation. It is however also possible to arrange gears on the third axle 10 in lieu of the roller 11, thus enabling the user to move the appliance 2 across the skin in either direction.

By virtue of the pivotal frames 12, 13 and the accordingly receding first and second axle 8, 10, the gears 9 and the roller 11 are able to conform themselves to any curvature on the skin.

What is claimed is:

1. An attachment for an appliance for epilation of human skin, the appliance including an epilation head disposed within a housing and a motor, the epilation head having at least one clamping device mounted to a first axle, the clamping device being coupled to the motor to be rotatably driven thereby for purposes of epilation, the housing defining an opening partially exposing the clamping element, said attachment comprising:

a frame and at least one element for reducing the perception of pain during epilation, said frame defining a central opening and removably seatable onto the housing of the epilation head to position said at least one element adjacent the clamping device so that said element contacts skin being epilated prior to the epilation.

2. The attachment of claim 1 wherein said element is mounted for rotation about a second axle which is aligned approximately parallel to the first axle.

3. The attachment of claim 2, wherein said element is one of a wheel and a gear which rolls off along the skin ahead of the epilation head.

4. The attachment of claim 3, wherein a plurality of elements are rotatably arranged on the second axle in a spaced, juxtaposed relationship to each other.

5. The attachment of claim 4, wherein the plurality of said elements are independently rotatable.

6. The attachment of claim 5, further including a third axle which is aligned approximately parallel to the first axle and has mounted on it one of a roller, a shaft, wheels and stimulating wheels for rotation thereon.

7. The attachment of claim 6, wherein at least one of the second and the third axle has mounts that pivot to recede toward the housing.

8. The attachment of claim 7, wherein at least one of the second and the third axle is spring loaded such as to project from the housing.

9. The attachment of claim 8, wherein the second axle and the third axle are independently movable with respect to the frame.

10. The attachment of claim 9, having a size and shape relative to the appliance such that the attachment can be push-fit onto the housing and is releasably lockable thereon.

11. An epilation appliance for epilating skin, the appliance comprising:

an epilation head having a first axle and at least one clamping device for epilation rotatably mounted thereto;

a housing defining an opening, the epilation head being disposed within said housing with the clamping device partially exposed by said opening;

a motor contained within the appliance and coupled to drive said clamping device; and an attachment comprising a frame and at least one element for reducing the perception of pain during epilation, said frame defining a central opening and removably seatable onto the housing of the epilation head so that the at least one element is adjacent the clamping device.

12. The attachment of claim 1, further comprising a spring biasing said element away from the frame.

13. The epilation appliance of claim 11, wherein said at least one element is rotatable independently of at least one of the motor and the clamping device.

14. The epilation appliance of claim 11, including, a plurality of elements for reducing the perception of pain during epilation, mounted along a second axle.

15. The epilation appliance of claim 14, wherein the plurality of elements are independently rotatable.

16. The epilation appliance of claim 14, wherein the second axle has mounts that recede toward the housing.

17. The epilation appliance of claim 14, wherein the second axle is spring loaded so as to project from the housing.

18. The epilation appliance of claim 11, wherein said at least one element is one of a wheel and a gear that rolls off along the skin ahead of the epilation head.

* * * * *